US008506206B2

(12) United States Patent
Desmeules

(10) Patent No.: US 8,506,206 B2
(45) Date of Patent: Aug. 13, 2013

(54) COMPOSITE PILE FORMED OF INTERCONNECTED RIGID HOLLOW TUBES

(75) Inventor: Alain Desmeules, Montréal (CA)

(73) Assignee: 9267-9075 Quebec Inc., Montreal (CA)

( * ) Notice: Subject to any disclaimer, the term of this patent is extended or adjusted under 35 U.S.C. 154(b) by 316 days.

(21) Appl. No.: 12/900,876

(22) Filed: Oct. 8, 2010

(65) Prior Publication Data

US 2012/0087741 A1 Apr. 12, 2012

(51) Int. Cl.
*E02D 7/00* (2006.01)

(52) U.S. Cl.
USPC ..... 405/232; 405/231; 405/251; 403/292

(58) Field of Classification Search
USPC ..... 405/231, 232, 249, 250, 251; 403/292, 403/298, 398, 384; 52/848, 153, 154, 148, 52/155, 165; 175/19, 22
See application file for complete search history.

(56) References Cited

U.S. PATENT DOCUMENTS 1,361,345 A * 12/1920 Ness et al. ..... 52/165
2,874,547 A * 2/1959 Fiore et al. ..... 405/254
3,004,784 A * 10/1961 Selby ..... 403/19
3,314,241 A * 4/1967 Mayhall ..... 405/228
4,733,994 A 3/1988 Simanjuntak
5,234,287 A 8/1993 Rippe, Jr.
6,142,710 A 11/2000 Holland, Jr. et al.
6,468,003 B2 10/2002 Merjan et al.
7,578,637 B2 8/2009 Song
7,708,317 B2 5/2010 Leblanc

* cited by examiner

*Primary Examiner* — Sean Andrish
(74) *Attorney, Agent, or Firm* — Norton Rose Fulbright Canada LLP

(57) ABSTRACT

A composite pile is comprised of two or more rigid hollow tubes interconnected together end-to-end by a pile connector. A boring head is secured to a leading lower end of a lowermost one of the tubes. A force transmitting member is removably connectable to a top end of an uppermost one of the rigid hollow tubes to receive a driving force for driving each of the two or more rigid hollow tubes into the ground. The pile connector has opposed axially aligned projecting pile connecting members extending from opposed parallel faces of a transverse impact transfer disc and extend a predetermined distance in adjacent open ends of the tubes to maintain the tubes in alignment with one another. The impact transfer disc is dimensioned to extend to an outer periphery of circumferential end edges of the rigid hollow tubes interconnected end-to-end and to receive the end edges in contact with the opposed parallel faces to transfer the driving force substantially uniformly between the end edges of the tubes interconnected together.

56 Claims, 12 Drawing Sheets

COMPOSITE PILE FORMED OF INTERCONNECTED RIGID HOLLOW TUBES

TECHNICAL FIELD

The present invention relates to a composite pile comprised of rigid hollow tubes interconnected together by a pile connector and wherein a lower one of the tubes has a boring head, and a force transmitting member is removably connectable to a top end of an uppermost one of the rigid hollow tubes.

BACKGROUND ART

Composite piles consist of tubes, concrete cylinders, solid rods, etc. interconnected end-to-end and driven into the soil. A pile head or pointed end structure is secured to a lower end of a first pile section. The sections are interconnected together by connectors and the piles are driven into the soil by impact blows on a head member adapted to receive these blows and removably secured to a top end of an uppermost one of the piles. The pile can also be driven into the soil by a hydraulic ram. Such composite piles are used to support a load at a top end thereof, such as a foundation, an above-ground pole, or any other above-ground structures requiring rigid connection with the ground. Composite piles are also utilized, as described in my U.S. patent application Ser. No. 12/497,560 and entitled "Soil Penetrating Plate Assembly To Position Geothermal Conduit Loops In Soil", for use in positioning geothermal tubes into the soil. When supporting existing foundations, the pile is driven into the soil adjacent the foundation and secured to a bracket which is connected to the foundation side surface. The piles may also be inserted into the soil at specific locations where building foundation footings are to be formed.

Pile heads are also known to provide ease of penetration of a pile into the ground but to also provide support for the pile. Reference is made to U.S. Pat. No. 4,733,994 wherein a pile support element is disclosed for supporting the entire pile and a load connected to an upper end thereof. The pile boring head has plates retained withdrawn therein and these are caused to protrude sideways from the pile body upon completion of the driving of the pile into the soil whereby to provide additional support for the pile. U.S. Pat. No. 7,578,637 also discloses a head-extended pile for supporting a load secured to the pile and wherein the boring head has a reinforcement part provided at the front end thereof which has a diameter larger than that of the pile so that the front end has an increased supporting force for the pile.

It is also known to have connectors which are securable to opposed ends of pile sections whereby to splice them together. U.S. Pat. No. 6,468,003 discloses such as connector which is in the form of an exterior collar adapted at one end to sit on the circumferential edge of a lower pile tube and adapted at an opposed end to receive an end portion of an upper pile tube. A disadvantage of such connectors is that the collar lies substantially exteriorly of the pile and becomes damaged as it is driven into the ground. Also, it does not provide a stability of the piles, that is to say, the pile sections can angulate from one another and destroy when impacted under ground level. The result of this malfunction of the connector is very labour-intensive, particularly if a pile needs to be driven into the soil at a specific location where the already driven pile sections need to be removed. In my U.S. Pat. No. 7,708,317, issued on May 4, 2010, entitled "Hollow Pipe Connector", I also disclose a connector which fits into opposed ends of a pile. The connector plates have a protrusion formed along opposed side edges thereof at substantially mid-length thereof to rest between the mating end edges of the hollow tubes for proper positioning in opposed pipe ends. Often, when the pile is subjected to impact blows this connector becomes unstable and damages the ends of the pile tubes causing ruptures, breakages and disconnection.

It is also known to utilize composite piles to support foundations or foundation slabs by securing a bracket to the foundation or the slab and providing a hydraulic ram connected to the bracket to drive a pile into the soil adjacent the foundation to provide support. Reference is made to U.S. Pat. Nos. 5,234,287 and 6,142,710 which show such bracket structures and lifting assemblies. There is a need to provide improvements of such brackets and lifting assemblies.

SUMMARY OF INVENTION

It is a feature of the present invention to provide an improved composite pile which is comprised of rigid hollow tubes interconnected end-to-end by a novel pile connector It is a further feature of the present invention to provide a composite pile comprising rigid hollow tubes with a lower leading one of the hollow tubes having an improved boring head which can also provide support for the pile.

Another feature of the present invention is to provide a composite pile comprised of rigid hollow tubes interconnected together end-to-end and wherein an improved force transmitting member is removably connectable to a top end of an uppermost one of the tubes to receive a driving force.

It is a further feature of the present invention to provide a composite pile comprised of two or more rigid hollow tubes interconnected together and wherein the pile connector, the boring head, and the force transmitting member are formed of interconnectable parts which are easy to assemble on site and which can easily be repaired, if damaged, and are easy to transport in a disassembled form.

Another feature of the present invention is to provide a novel pile connector formed of inter-engaging parts comprised of an impact transfer disc and a pair of projecting pile connecting members interconnectable together and with the impact transfer disc.

Another feature of the present invention is to provide a boring head formed of inter-engaging parts comprised of a tapered boring outer end section and a pile seating flange wall section.

Another feature of the present invention is to provide a force transmitting member for a composite pile which is comprised of inter-engaging parts formed by a rigid disc and a connecting plate to secure the disc to a top end of a hollow rigid pile tube.

According to the above features, from a broad aspect, the present invention provides a composite pile comprised of two or more rigid hollow tubes interconnected together end-to-end by a pile connector. A boring head is secured to a leading lower end of a lowermost one of the tubes. A force transmitting member is removably connectable to a top end of an uppermost one of the rigid hollow tubes to receive a driving force for driving each of the two or more rigid hollow tubes into the soil. The pile connector has opposed axially aligned projecting pile connecting members extending from opposed parallel faces of a transverse impact transfer disc and extending a predetermined distance in adjacent open ends of the tubes to maintain the tubes in axial alignment with one another. The impact transfer disc is dimensioned to extend to an outer periphery of circumferential end edges of the rigid hollow tubes interconnected end-to-end and to receive the end edges in contact with the opposed parallel faces to transfer the driving force substantially uniformly between the end edges of the tubes interconnected together.

According to a still further broad aspect of the present invention there is provided a pile connector for interconnecting rigid hollow pile tubes end-to-end and for transmitting driving forces between adjacent ends of the rigid hollow pile tubes. The pile connector has opposed axially aligned projecting pile connecting members extending from opposed parallel faces of a transverse impact transfer disc. The impact transfer disc is dimensioned to extend to an outer periphery of circumferential end edges of the rigid hollow pile tubes interconnected end-to-end.

According to a still further broad aspect of the present invention there is provided a pile supporting boring head for securement to a lower end of a rigid hollow pile tube to be driven into the ground. The pile supporting head is formed of inter-engaging parts to form a tapered boring outer end section and a pile seating wall section. The tapered boring outer end section is formed by a pair of inter-engaging plates each defining the tapered outer end section in a forward portion thereof and a tube connecting section in a rearward portion thereof. Interconnecting support means is also provided to supportingly connect the pile seating flange wall section thereto.

According to a still further broad aspect of the present invention there is provided a force transmitting member for removable connection to a top end of a rigid hollow pile tube to be driven into the ground and adapted to receive a driving force. The force transmitting member is a rigid disc removably connected to the top end of the rigid hollow tubes and extending across the top end. A connecting plate is dimensioned to fit into the top end for securing the disc transversely over the top end.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
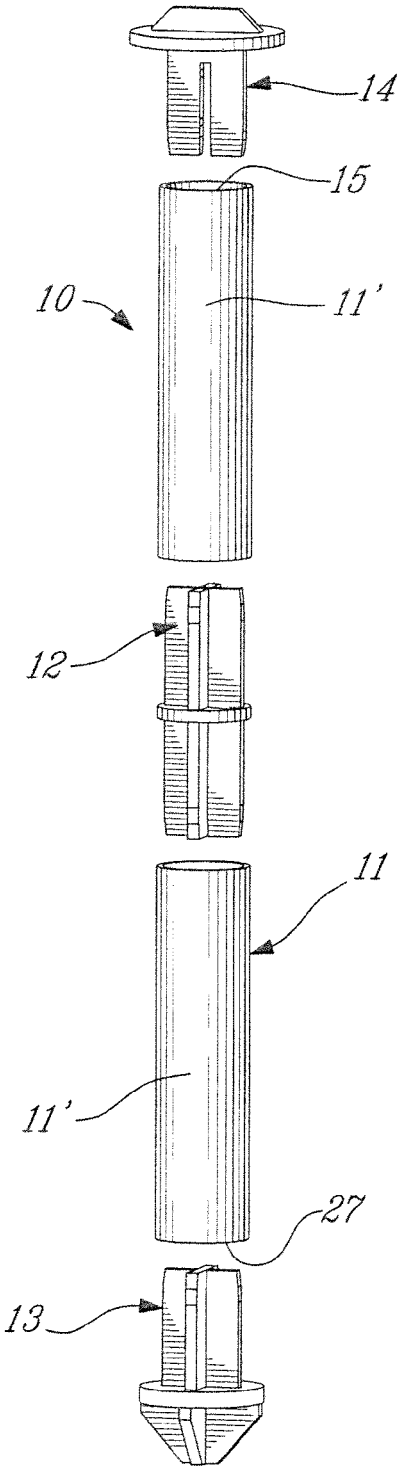
FIG. 1 is a simplified exploded side view showing a composite pile constructed in accordance with the present invention.

Referring now to the drawings and more particularly to FIG. 1, there is shown generally at 10 a composite pile constructed in accordance with the present invention and comprised of two or more rigid hollow tubes 11 interconnected together end-to-end by pile connectors 12. The rigid hollow tubes 11 are preferably steel tubes but may be tubes formed of other suitable materials. Similarly, the pile connectors 12 may be constructed of inter-engaging steel parts or other suitable material.

A lowermost one of the pile tubes, herein pile tube 11', is fitted with a boring head 13 which is adapted to penetrate into the soil and to provide support for the assembled composite pile when driven to a position of rest. A force transmitting member 14 is removably connectable to a top end 15 of an uppermost tube 11" to receive a driving force, such as impact blows, for driving the interconnected rigid hollow tubes 11 into the soil.

Figure 2A:
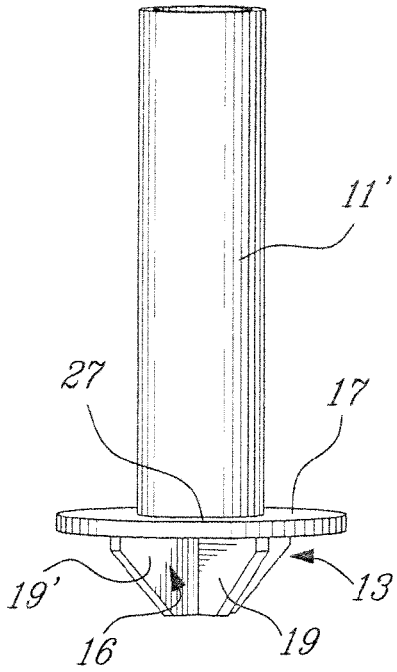
FIG. 2A is a perspective view illustrating the boring head of the present invention secured inside a leading lower end of a lowermost one of a rigid hollow tube forming the composite pile.
Figure 2B:
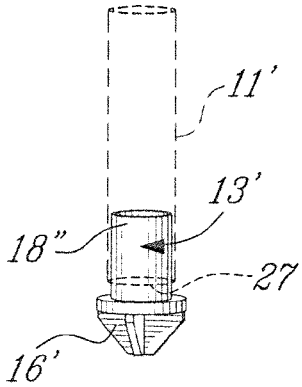
FIG. 2B is a perspective view illustrating a further embodiment of the boring head and secured inside the leading lower end of the composite pile.
Figure 2C:
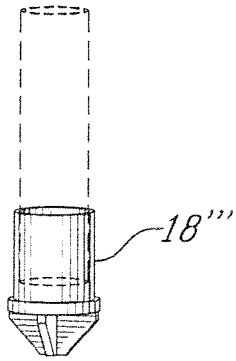
FIG. 2C is a perspective view illustrating a modification of the boring head of FIG. 2B.
Figure 3:
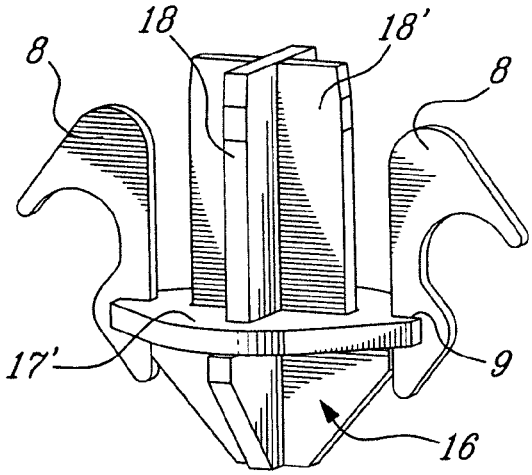
FIG. 3 is a perspective view of a modification of the boring head.
Figure 4:
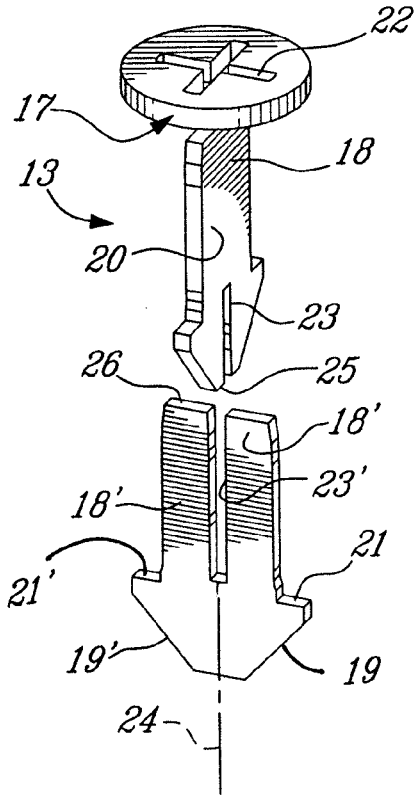
FIG. 4 is an exploded view of the boring head showing the inter-engaging interconnection of the plates.

With reference now to FIGS. 2A to 4, there is shown the construction of the boring head 13. As hereinshown the boring head 13 is formed of inter-engaging parts to form a tapered boring outer end section 16 and a pile seating flange wall section 17. The tapered boring outer end section 16, as more clearly shown in FIGS. 3 and 4, is formed by a pair of inter-engaging plates 18 and 18', each defining a tapered, arrowhead shaped, outer end section 19 and 19' in a forward portion thereof. Tube connecting sections 20 and 20', respectively, extend rearwardly of the tapered outer end sections 19 and 19'. The tube connecting sections 20 and 20' are flat plate sections having a width for friction-fit connection inside the lowermost one 11' of the rigid hollow tubes, as shown in FIG. 2A. The tapered outer end sections 19 and 19' define support ledges 21 and 21', respectively, on which is supported the pipe seating flange wall section 17, herein in the form of a circular seating disc. The seating disc has cross slots 22 for the passage of the pair of inter-engaging plates 18 and 18' when interconnected together as shown in FIG. 4. In order to interconnect the plates together each of the inter-engaging plates 18 and 18' are provided with a connecting slot 23 and 23', respectively, extending along a central longitudinal axis 24 thereof. The connecting slot 23 of interconnectable plate 18 extends from a free end 25 of the outer end section 19 and the other of the connecting slots 23' extend from a free rear end 26 of the other end connecting plate 18'.

As shown in FIG. 2A, the seating disc or seating flange wall section 17 is dimensioned whereby to extend outwardly about the outer circumference of the leading lower end 27 of the lowermost rigid hollow tube 11' whereby to provide support of the composite pile 10 in the soil. Depending on the soil structure this pile seating flange can be of a selected diameter size. Also, the tube connecting sections 20 and 20' have a length dimensioned to provide for a rigid interconnection of the boring head 13 with the lowermost rigid hollow pile tube 11'. FIG. 2B shows another embodiment wherein the boring head 13' is herein formed as a single unit having a boring outer end section 16' and a connecting cylinder 18" tapered for friction fit in the lower leading end 27 of the hollow tube 11'. In FIG. 2C, the connecting cylinder 18'" is dimensioned to receive the lower end portion of the hollow tube 11' in friction fit therein. FIG. 3 shows a modification wherein the seating wall flange section 17' is elliptically formed with opposed connecting slots 9 to receive conduit connecting hook members 8 for welding thereto. These hook members 8 are designed to hook a loop end of a geothermal conduit loop thereto and draw it into the soil.

Figure 5:
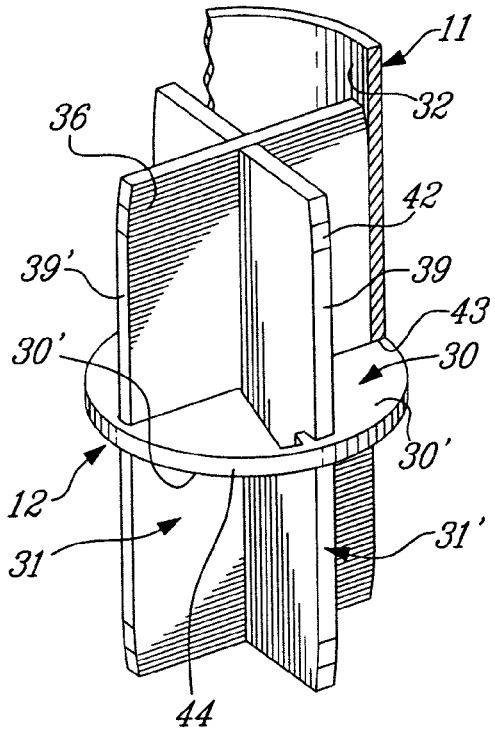
FIG. 5 is a perspective view of the pile connector.
Figure 6:
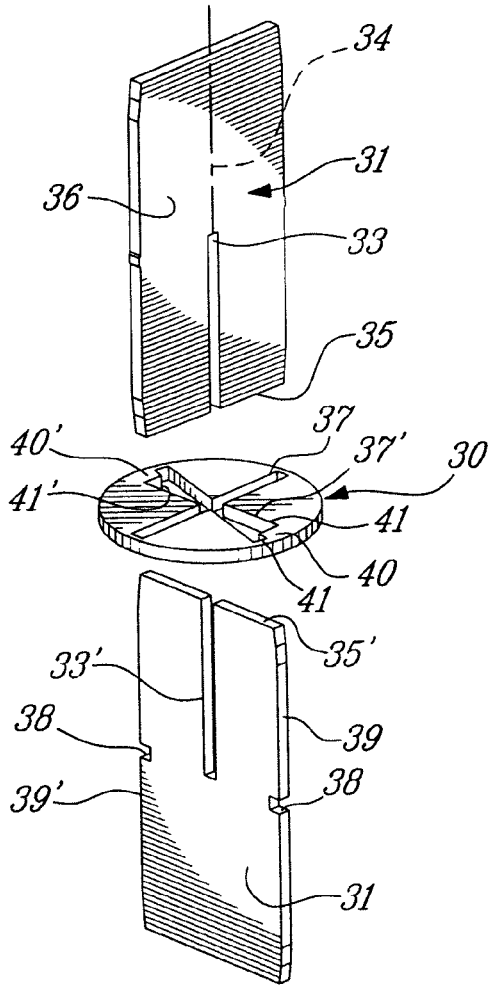
FIG. 6 is an exploded view showing the inter-engaging parts of the pile connector which is comprised of a pair of inter-engaging pile connecting plates and an impact transfer disc.

Referring now to FIGS. 5 to 8B, there will be described the construction of the pile connector 12. As shown in FIG. 6, the pile connector 12 is comprised of an impact transfer disc 30 herein a circular disc for abutting relationship with circular rigid hollow pile tubes 11 but may be of different circumferential shape if the rigid hollow tubes 11 are of a different circumferential shape also to provide flush seating engagement with opposed flat ends of the hollow tubes, as will be described later. The pile connector 12 is also comprised of a pair of inter-engaging pile connecting plates 31 and 31' which are dimensioned to extend a predetermined distance and in frictional engagement with an inner side wall 32 of a rigid hollow tube 11, a fragmented portion of the tube 11 being shown in FIG. 5. These pile connecting plates have connecting slots 33 and 33', respectively, formed in each plate and extending along a longitudinal axis 34 thereof from adjacent end edges 35 and 35', respectively thereof and terminate at substantially mid-length of the pile connecting plates 31, 31'. At least one of the plate connecting slots 33 or 33' is dimensioned or has a width to provide for a loose fit connection with a side wall such as side wall 36 of plate 31, as shown in FIG. 5, to permit predetermined angular or articulated displacement between the plates whereby to provide for interconnection with the impact transfer disc 30.

As shown in FIG. 6, the impact transfer disc 30 is provided with cross-slots 37 for receiving the pile connecting plates when connected together as shown in FIG. 5. One of the pile connecting plates, herein plate 31', is provided with a pair of notches 38 formed in a respective one of opposed longitudinal side edges 39 and 39' and aligned transverse to one another. These notches 38 provide for a removable connection to secure the connecting plates to the impact transfer disc 30 at substantially mid-length of the pile connecting plates. A connector ledge 40 is formed adjacent opposed ends 41 of the cross-slot 37'. The notches 38 are dimensioned for close fit reception of an associated one of the connector ledges 40 and 40', respectively therein, as shown in FIG. 5. The connecting cross-slot 37' has opposed aligned angulated passages 41 and 41' to permit pivotal side displacement of the connecting plate 31' in loose-fit connection with the other connecting plate 31, as above-described, whereby the connecting plates are captively retained in the impact transfer disc 30. As clearly shown in FIG. 5, the opposed longitudinal side edges 39 and 39' of the pile connecting plates 31 and 31' have an inward taper 42 at their opposed end portions for ease of insertion in connecting ends of the rigid hollow tubes. As previously described, the pile connecting plates 31 and 31' have a predetermined length whereby to extend a predetermined distance in adjacent open ends of adjacent rigid hollow tubes 11 to maintain the tubes in alignment with one another and solidify the interconnected ends of the piles. As also shown in FIG. 5, the impact transfer disc 30 has an outer diameter whereby to extend to an outer periphery of the circumferential end edge 43 of the rigid hollow tube 11 with the edges 43 in flush contact with the opposed parallel faces 30' of the disc whereby to transfer the driving force substantially uniformly between the end edges 43 of the rigid hollow tubes 11 interconnected together and stabilized in alignment by the pile connecting plates 31 extending in the opposed ends thereof. Accordingly, a rigid interconnection is made between the ends of the rigid hollow tubes and impact forces are transmitted axially through the impact transfer disc in flush contact with the opposed end edges of the opposed interconnected rigid hollow tubes preventing buckling and disengagement. The disc also does not extend beyond the outer surfaces of the piles. The impact transfer disc and the pile connecting plates are preferably, but not exclusively, constructed of steel.

Figure 7:
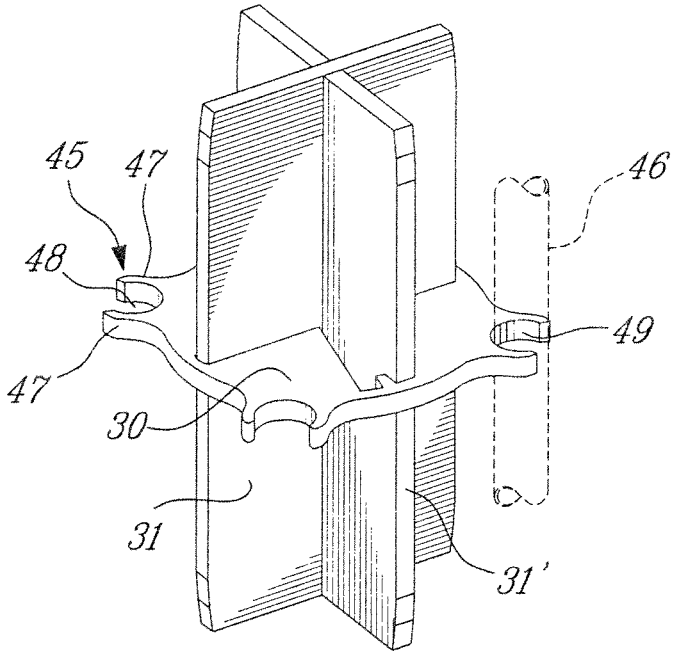
FIG. 7 is a perspective view showing a modification of the impact transfer disc herein provided with conduit connecting formations extending exteriorly of the outer circumferential edge thereof to retain a conduit along the composite pile tubes.

As shown in FIG. 7, the impact transfer disc 30 may also be provided with one or more conduit connecting formations 45 extending exteriorly of the outer circumferential edge 44 of the disc whereby to retain a conduit 46 close to the side wall of the rigid hollow tubes as the pile is driven into the ground. For this application the formation 45 of the disc extends beyond the outer surfaces of the piles. These connecting formations 45 are made to provide minimal obstruction and as hereinshown they are constituted by a pair of rigid curved clamping fingers 47 defining a restricted throat opening 48 between opposed ends thereof leading to a retention cavity 49 configured to receive the conduit 46 therein. As hereinshown, the conduit is a flexible conduit for snap-fit retention within the retention cavity 49. The flexible conduit can be one of a geothermal conduit, an electrical cable or a hollow conduit for the passage of hydraulic lines and other wiring or devices not shown herein.

Figure 8A:
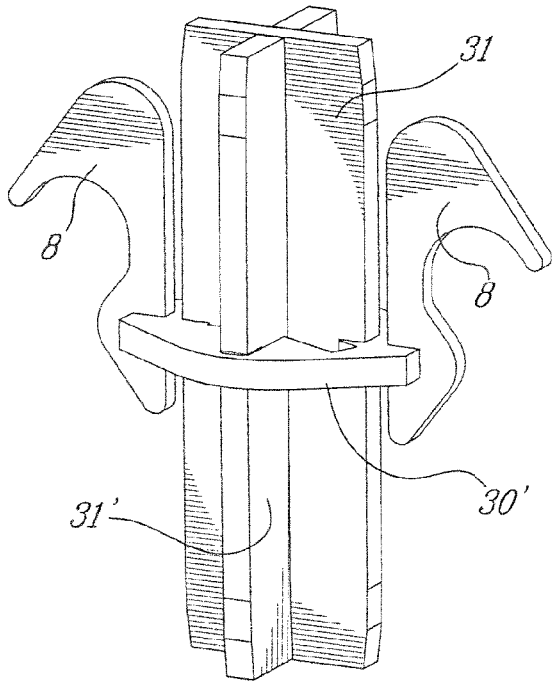
FIG. 8A is a perspective view of a further embodiment of the conduit connecting formations.
Figure 8B:
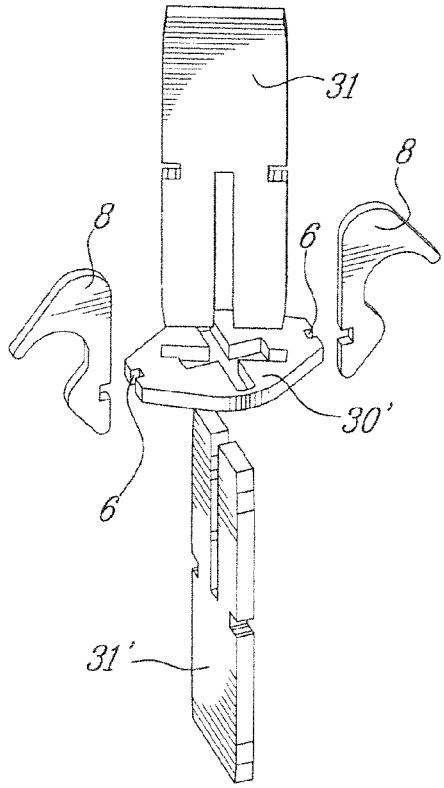
FIG. 8B is an exploded view of FIG. 8A.

FIGS. 8A and 8B show a further embodiment of the impact transfer disc 30' which is herein formed of substantially elliptical shape with opposed connecting slots 6 dimensioned to receive the conduit connecting hook members as shown in FIG. 2D for welding thereto. Such impact transfer disc 30' can be positioned at a desirable pipe joint which will determine the depth at which a geothermal conduit loop is to be positioned along the entire pile length.

Figure 9A:
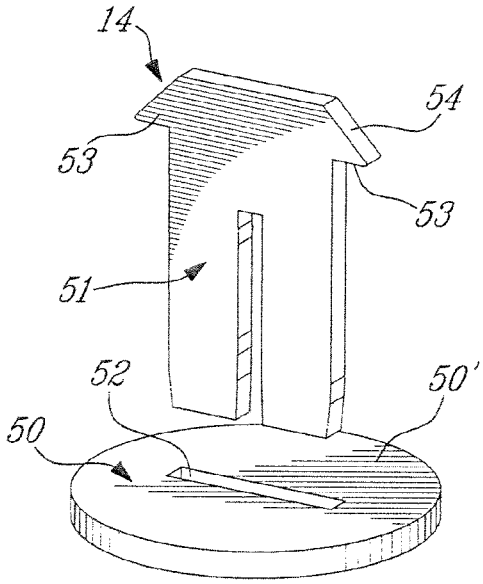
FIG. 9A is an exploded view showing the construction of a force transmitting member which is connectable in the top end of an upper one of hollow tubes forming a composite pile.
Figure 9B:
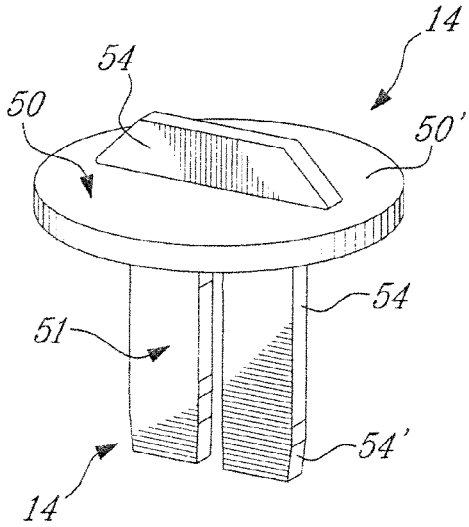
FIG. 9B is a perspective view of the force transmitting member in an assembled form.

Referring now to FIGS. 9A and 9B, there is shown the construction of the force transmitting member 14. As hereinshown it is constituted by a rigid steel disc 50 removably connected to the top end of the uppermost rigid hollow tube 11" (see FIG. 1) with the disc extending across the top end of the tube 11". A slotted connecting plate 51 retains the disc 50 over the top end 15 of the rigid hollow tube 11". To do so, the rigid disc 50 has a plate receiving slot 52 which is at least as long as the inner diameter of the tube 11". The connecting plate 51 is of substantially rectangular shape and dimensioned for close fit across the inner wall 32 of the rigid hollow tubes. The connecting plate 51 is also provided with opposed edges 54 having a tapered lower end 54' for ease of insertion in the top end of the uppermost tube 11'. The connection plate 51 also has shoulder portions 53 which extend transversely of the connecting plate at a top end thereof and projects on opposed side edges of the plate receiving slot 52 for arresting abutment on the top surface 50' of the rigid disc 50 adjacent opposed ends of the plate receiving slot 52. The connecting plate 51 prevents the rigid disc 50 from wobbling when secured to the top end of the tube 11".

The rigid disc 50 has an outer circumference which is also greater than the outer circumference of the rigid hollow tube 11". When driving the last rigid hollow tube of the composite pile 10, such as tube 11" in FIG. 1, or after it is driven into the soil, a different size disc 50 may be secured at the end of the uppermost tube 11" whereby to provide a support base for a concrete footing to be formed over the pile. The footing provides a base for a structure or an attachment for a connector, etc.

Figure 10A:
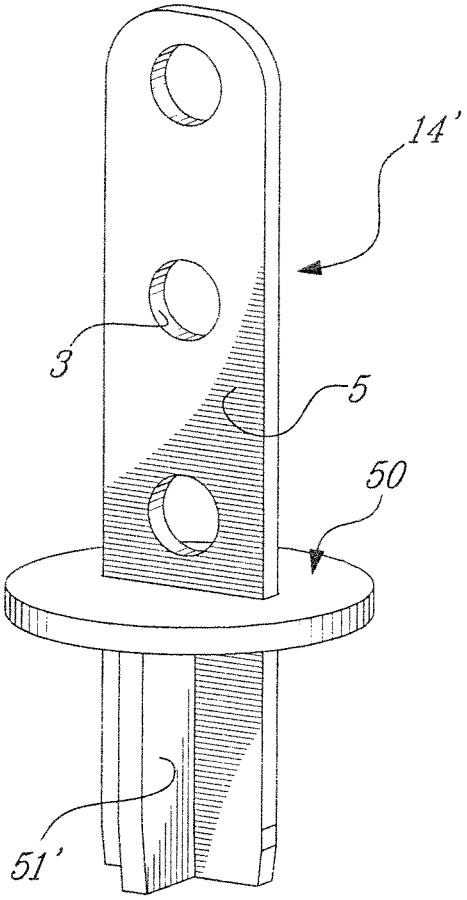
FIG. 10A is a perspective view of a modified force transmitting member adapted for immovable engagement in a concrete form.
Figure 10B:
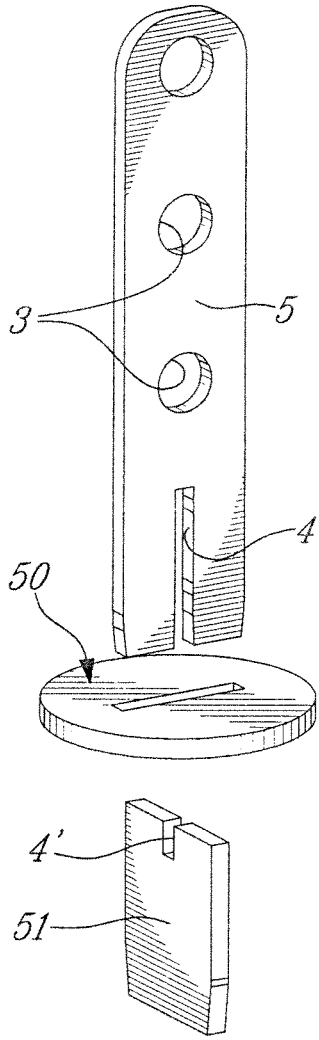
FIG. 10B is an exploded view of FIG. 10A.

FIGS. 10A and 10B show a modification to the force transmitting member, herein member 14', wherein the connecting plate 51 has a tube connecting portion 51' and a concrete anchor projecting vertical plate 5 interconnected therewith by slots 4 and 4'. The anchor plate 5 is also provided with through bores 3 for anchor within concrete.

Figure 11B:
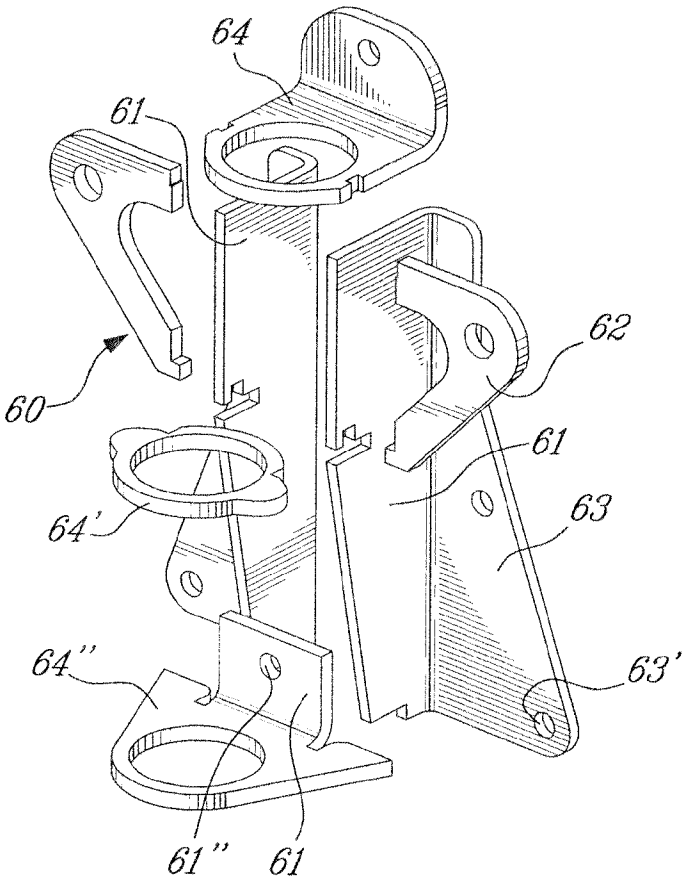
FIG. 11B is an exploded perspective view of FIG. 11A.
Figure 11A:
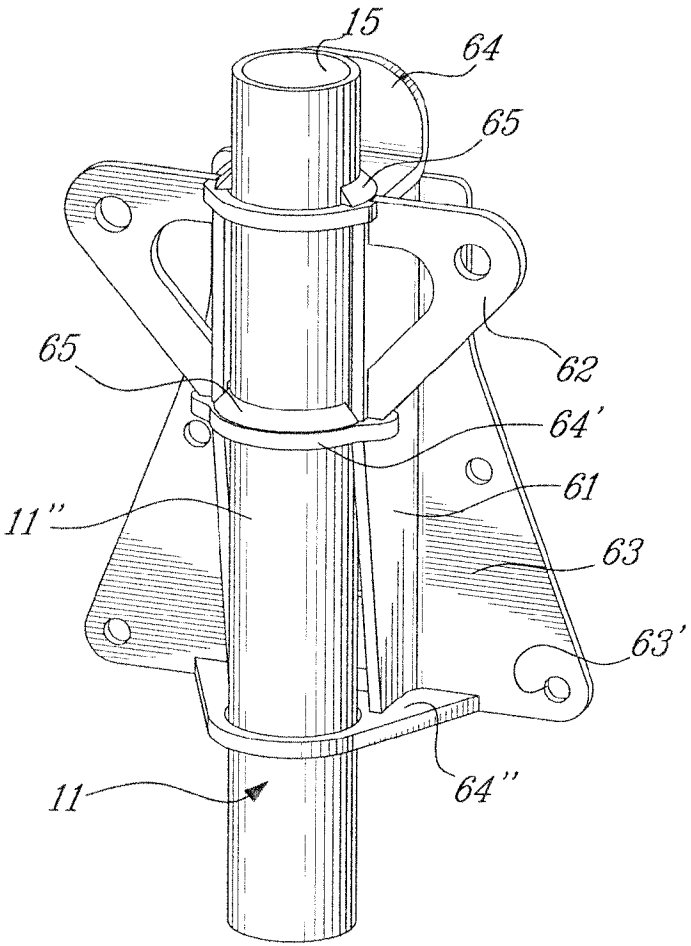
FIG. 11A is a perspective view of a bracket adapted to secure to a structure and to an hydraulic ram for building a pile as it is driven into the soil and to secure to the pile after it is driven to its final position of rest.

It is also pointed out that the composite pile 10, as illustrated in FIG. 1, is one which has an outer diameter in the order of about up to 6 inches, and as stated above, preferably constructed of hollow steel tubes. Such composite piles are commonly used to support foundation walls or concrete slabs on which building structures are constructed. With such use, it is necessary to secure a pile connecting metal brackets to the concrete structure and examples of these brackets are illustrated in FIGS. 11A to 17. As shown in FIGS. 11A and 11B, the force transmitting member is constituted by a hydraulic ram, not shown but well known in the art, secured to a pile connecting metal bracket 60 adapted to be secured to a structure, such as a foundation wall, to be supported by the composite pile 10. The pile connecting bracket has guide means in the form of a pair of elongated straight vertical guide walls 61 spaced apart for close fit on opposed sides of a driven one of the rigid hollow tubes, herein tube 11. Elbow flanges 62 are welded to the guide walls 61 for attachment of an hydraulic ram (not shown). The guide walls 61 have integrally formed right angle flanges 63 to attach the bracket to a foundation wall. Holes 63' receive fastener bolts for the attachment. Horizontal guide ring fitments 64, 64' and 64" guide the tube 11 along the vertical length of the bracket and are welded thereto. After the pile has been driven into the soil, the uppermost tube 11" is welded to the guide ring fitments as shown at 65 in FIG. 11A to make the connection to the foundation. As previously mentioned, the elbow flanges 62 provide for a connection to hydraulic cylinders of the ram which drives the hollow tube 11 downwardly between the guide ring fitments and guide walls 61.

Figure 12C:
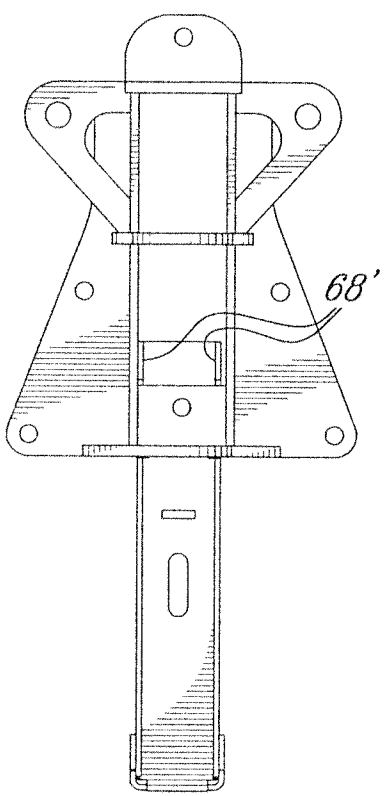
FIG. 12C is a front view of FIG. 12A.
Figure 12B:
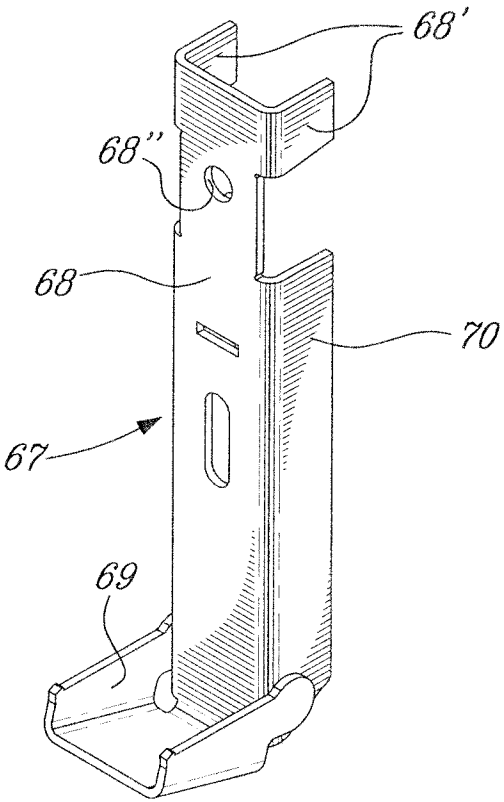
FIG. 12B is a perspective view of the foot plate.
Figure 12A:
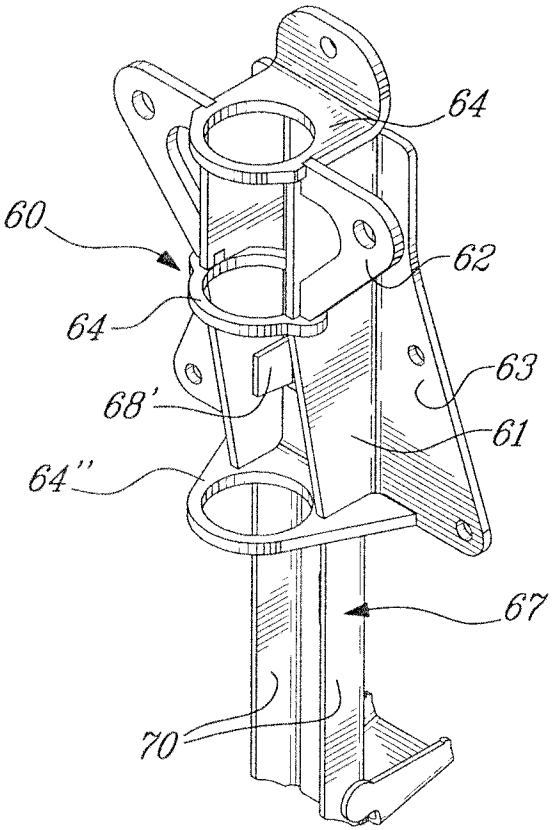
FIG. 12A is a perspective view showing a foot plate secured to the bracket of FIG. 11A.

As shown in FIGS. 12A to 12C, a rigid foot plate attachment 67 can also be secured to the bracket 60 in a manner as shown in FIG. 12A and welded thereto. The foot plate attachment has a vertical reinforced connecting wall section 68 and a lower transversely projecting support shoe 69 adapted to engage under a straight foundation wall of a structure to be supported by the pile 11. The wall section 68 has opposed parallel spaced reinforcing walls 70 and they also guide the steel tubes of the pile therebetween. Connecting wings 68' project in an opposed direction to the support shoe 69 and are adapted to project between the guide walls 61 over the upwardly turned connecting flange 61' of the lowermost guide ring fitment 64". A hole 68" in the connecting wall section 68 is positioned for alignment with the hole 61" in the connecting flange 61' for attachment to the bracket. The connecting wings 68' can also be welded to the connecting flange 61' and the guide walls 61.

Figure 13A:
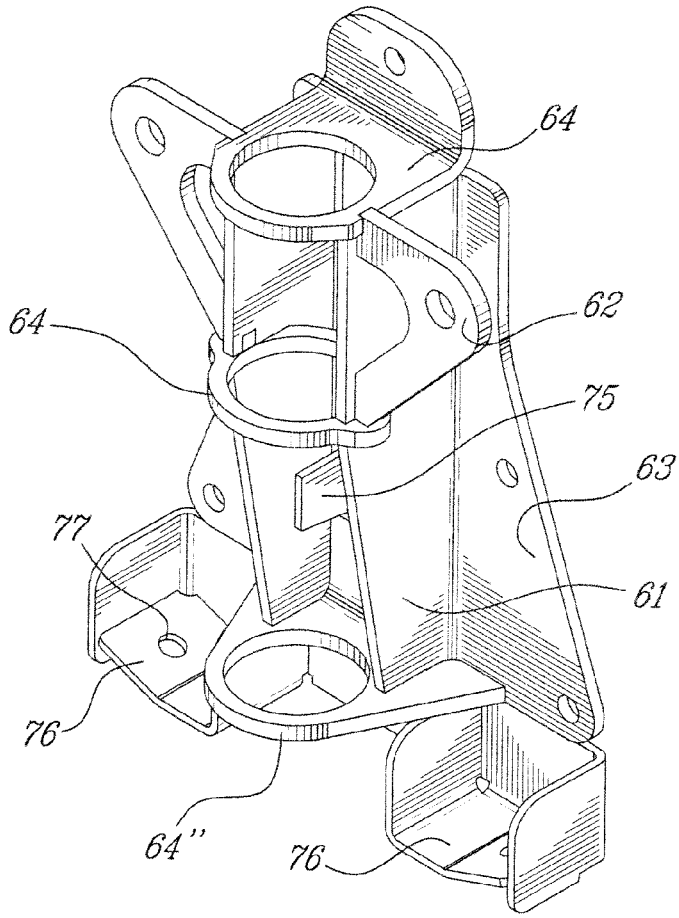
FIG. 13A is a perspective view showing a footing attachment plate connected to the bracket of FIG. 11A.
Figure 13B:
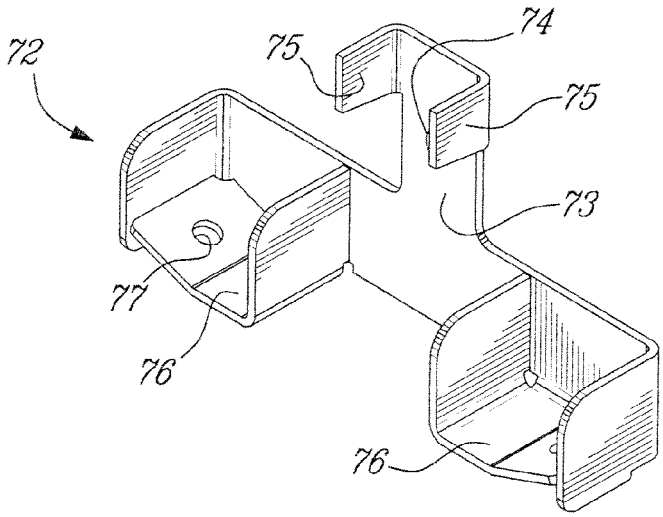
FIG. 13B is a perspective view of the footing attachment plate.

FIGS. 13A and 13B show a further attachment, herein a foundation footing attachment 72 adapted for securement to the bracket 60 and welded thereto, as shown in FIG. 13A. The footing attachment 72 is formed from a single steel piece die cut and folded to form a vertical central attachment wall 73 having a hole 74 therein and a pair of connecting wings 75 to be welded to the vertical guide walls 61 of bracket 60. The hole 74 is adapted to align with the hole 61" of the guide ring fitment 64" to receive bolt for connection thereto or to a foundation wall supported on a concrete footing, not shown but obvious to a person skilled in the art. A pair of horizontal connecting formations 76 are spaced-apart and one on opposed sides of the attachment wall 73 and project forwardly thereof. They have holes 77 to receive bolts for securement on top of the footing. A hole is bored in the footing between the connecting formations 76 for the passage of the tubes of the pile 11.

Figure 14A:
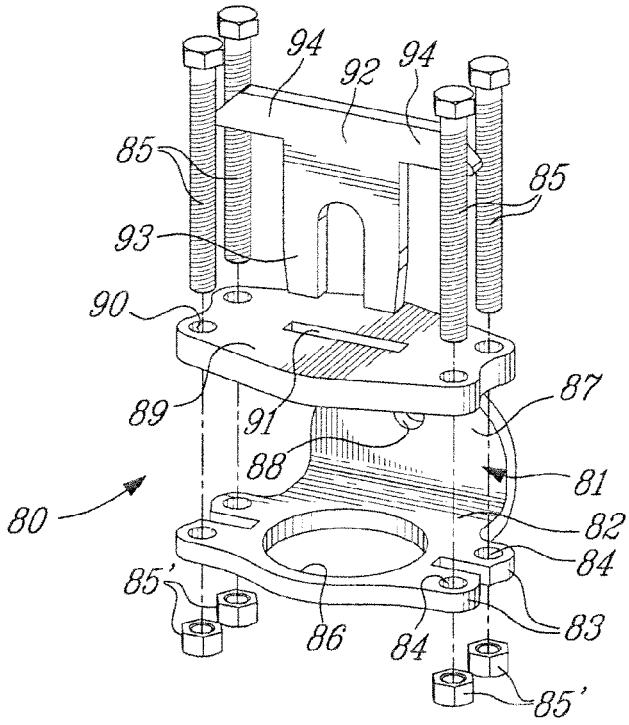
FIG. 14A is an exploded perspective view of a pile connecting clamp assembly securable to the top end of the pile to secure same to the bracket of FIG. 11A.
Figure 14B:
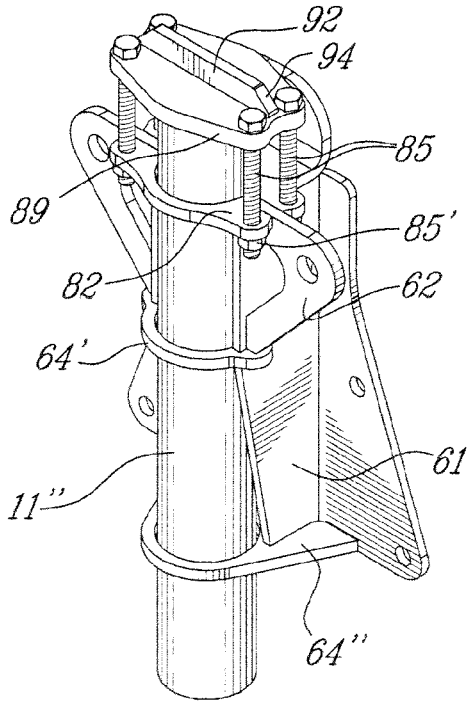
FIG. 14B is a perspective view of the pile connecting clamp assembly secured to the bracket and the top end of a pile.

FIGS. 14A and 14B show a pile connecting clamp assembly 80 securable to the top end tube 11" of the pile to secure the pile to the bracket 60. As hereinshown, a guide ring fitment 81 is welded on top of the vertical guide walls 61. It has a horizontal attachment wall 82 provided with extension fingers 83 having through bores 84 therein for receiving connecting bolts 85. The attachment wall 82 has a large bore 86 for the passage of the pile tubes 11". The attachment wall 82 is welded on top of the elbow flanges 62 and the guide walls 61. An upturn flange wall 87 is formed with the attachment wall 82 and provided with a hole 88 to receive a bolt for attachment to a foundation wall.

The clamp assembly 80 is further provided with a cover top plate 89 having holes 90 therein for alignment with the through bores 84 in the attachment wall 82 of the fitment 81. It is also provided with a central slot 91 to receive a tube alignment insert 92 having an extension foot 93 for friction fit engagement in the open top end 15 of the pile tube 11", see FIG. 11A. The insert 92 has opposed top arms 94 for welding on the top face 95 of the top plate 89. When the bolts 85 secure the top plate 89 resting on top of the pile tube 11", as shown in FIG. 14B, to the attachment bore wall 82, by the use of nuts 85', the pile tubes 11 are immovably secured to the bracket 60 and the foundation wall of a structure to be supported or reinforced by the pile.

Figure 15B:
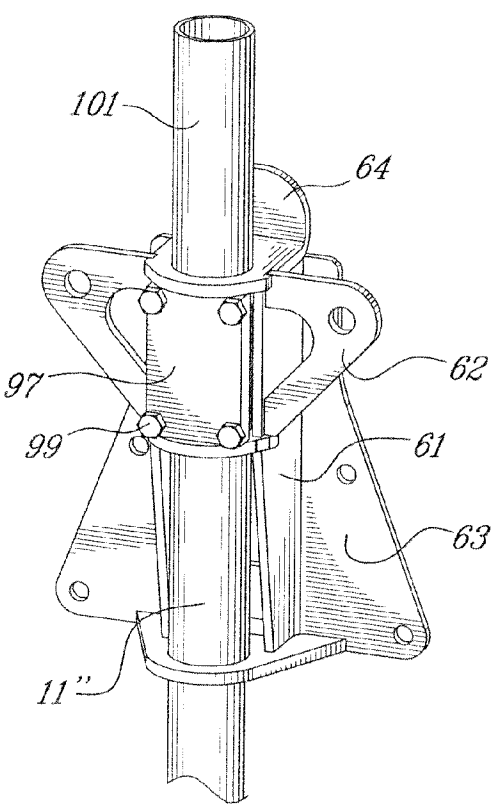
FIG. 15B is a perspective view showing the clamp of FIG. 15A secured to the bracket and the pile.
Figure 15A:
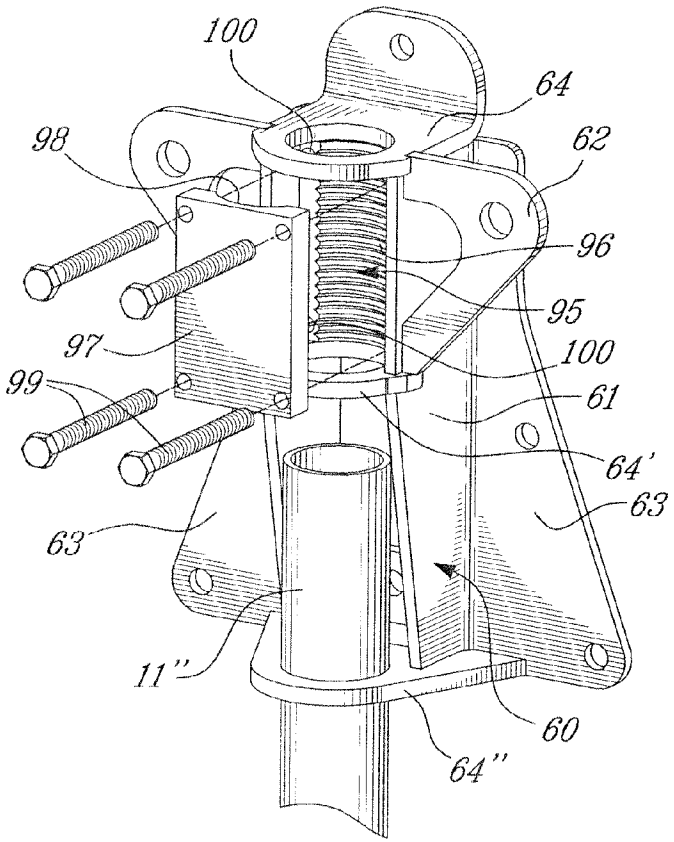
FIG. 15A is an exploded view of a further pile connecting clamp.
Figure 16C:
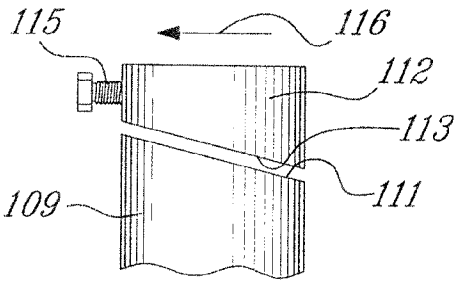
FIG. 16C is a fragmented side view of the actuating ring positioned on the clamping sleeve.

FIGS. 15A and 15B show a still further embodiment of a pile tube attachment securable to the bracket 60. As hereinshown, the attachment is a serrated clamp 95 formed by a clamping arcuate wall member 96 welded between the guide walls 61 in a top end rear section thereof and a clamping block 97, also having an arcuate serrated inner wall section for clamping the uppermost tube 11" therebetween. Threaded bolts 99 secure the clamping block 97 to the wall member in aligned threaded bores 100. As shown in FIG. 15B, the end section 101 of the tube 11" is cut flush with the guide ring fitment 64 after the clamp 95 is installed.

Figure 16B:
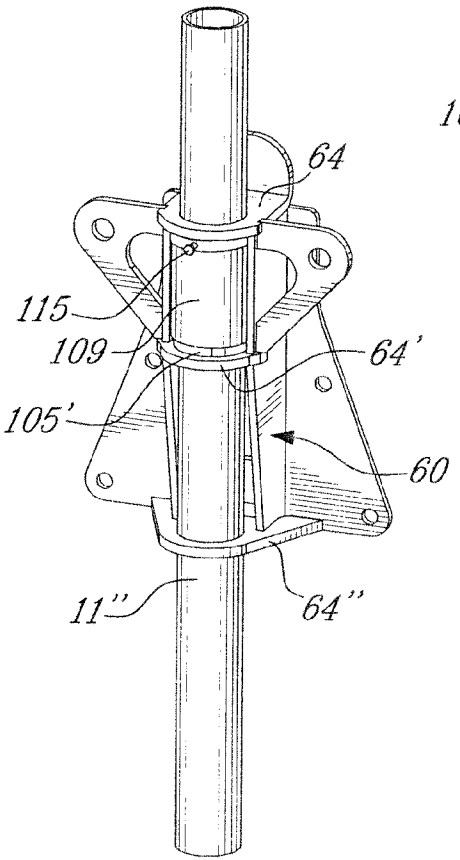
FIG. 16B is a perspective view showing the clamp of FIG. 16A secured to the bracket and the pile.
Figure 16A:
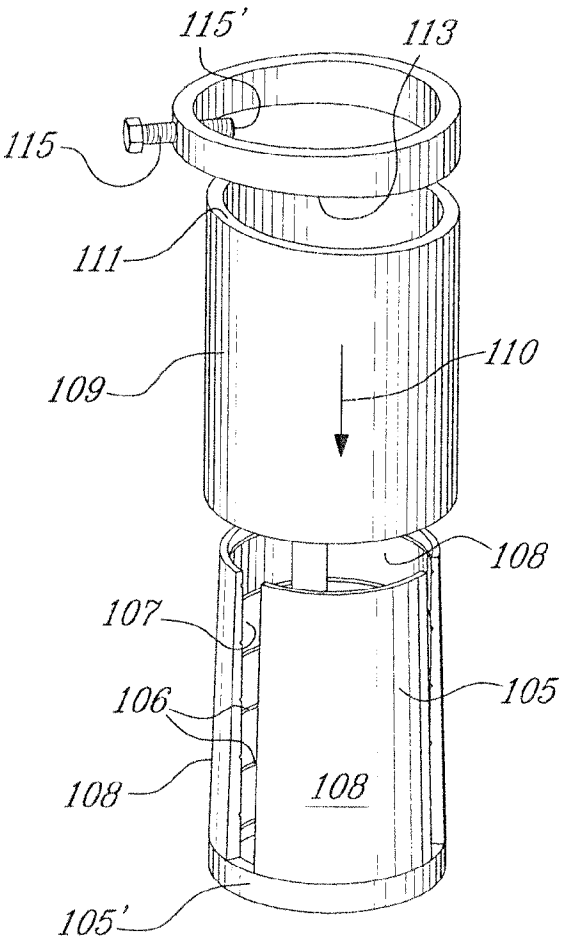
FIG. 16A is an exploded view of a still further pile connecting clamp.

FIGS. 16A and 16B show a still further embodiment of a pile tube attachment securable to the bracket 60. As herein-shown, it comprises a tapered clamping cone 105 having serrations 106 on an inner face 107 thereof. The cone 105 is formed of at least two, herein three, separate vertical wall sections 108, intended to flex slightly inward from a circular base 105' when a clamping sleeve 109 having an inner tapered face is formed downward thereover in the direction of arrow 110. The top edge 111 of the sleeve 109 is tapered in a rearward direction, as shown in FIG. 16A. An actuating ring 112 is of slightly oval shape and also has a tapered lower edge 113 and is disposed for contact against the tapered top edge of the clamping sleeve 109, as shown in FIG. 16A. The clamping cone 105, the sleeve 109 and the actuating ring 112 are disposed one on top of the other and retained captive between the guide ring fitments 64 and 64' with the tube sections 11" extending therethrough, as shown in FIG. 16B, and movable therethrough as it is driven downwards. Once the pile has been driven to its destination, the actuating bolt 115, threaded in the ring 112, is rotated to draw the actuating ring 112 in the direction of arrow 116 as shown in FIG. 16A. The bolt 115 has a free end 115' disposed to abut a side surface of the hollow tube 11" extending through actuating ring 112, to cause lateral displacement of the ring when the bolt 115 is forceably threaded in the ring. The displacement between the tapered ends 113 and 111 and the fact that the ring 112 is in contact under the fitment 64, causes the clamping sleeve 109 to be forced downward over the clamping cone 105 causing the cone section 108 to bend inwardly and apply a clamping force against the pile tube 11" extending therethrough and thus interconnecting the pile to the bracket 60 and the foundation structure to which it is secured.

Figure 17:
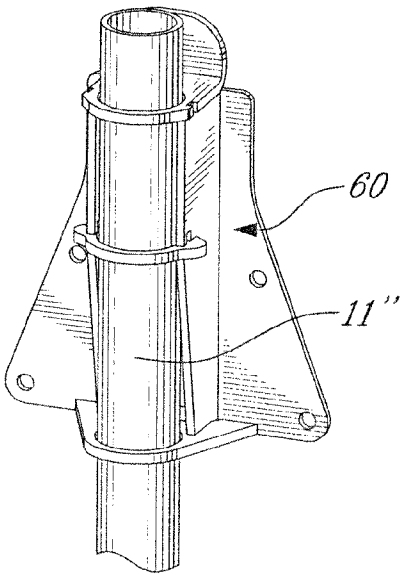
FIG. 17 is a perspective view of the bracket showing the elbow flanges removed.

As shown in FIG. 17, the elbow flanges 62 may be removed after the bracket 60 has been secured to the uppermost pile tube 11", for re-connection to another bracket 60 being constructed.

It is within the ambit of the present invention to provide any obvious modifications over the preferred embodiment described herein provided such modifications fall within the scope of the appended claims.

I claim:

1. A composite pile comprising two or more rigid hollow tubes interconnected together end-to-end by a pile connector, a boring head secured to a leading lower end of a lowermost one of said tubes, and a force transmitting member removably connectable to a top end of an uppermost one of said rigid hollow tubes to receive a driving force for driving each said two or more rigid hollow tubes into the soil, said pile connector having opposed axially aligned projecting pile connecting members extending from opposed parallel faces of a transverse impact transfer disc and extending a predetermined distance in adjacent open ends of said tubes to maintain said tubes in axial alignment with one another, said impact transfer disc being dimensioned to extend to an outer periphery of circumferential end edges of said rigid hollow tubes interconnected end-to-end and to receive said end edges in contact with said opposed parallel faces to transfer said driving force substantially uniformly between said end edges of said tubes interconnected together, and wherein said pile connecting members are formed by a pair of inter-engaging pile connecting plates, said pile connecting plates being dimensioned to extend said predetermined distance and in frictional engagement with an inner side wall of said rigid hollow tubes from said adjacent open ends, interconnection means to interconnect said pile connecting plates together in transverse relationship along a central longitudinal axis thereof, said impact transfer disc having cross-slots dimensioned for receiving said interconnected pile connecting plates therethrough, and removable connection means to secure said interconnected pile connecting plates to said impact transfer disc at substantially mid-length of said pile connecting plates.

2. The composite pile as claimed in claim 1 wherein said interconnection means is comprised of a plate connecting slot formed in each said pile connecting plates and extending along said central longitudinal axis form an adjacent end edge of said pile connecting plates and terminating at said mid-length of said pile connecting plates.

3. The composite pile as claimed in claim 2 wherein at least one of said plate connecting slots is dimensioned for loose fit connection with a side wall of said pile connecting plates to permit predetermined angular displacement between said plates.

4. The composite pile as claimed in claim 1 wherein said removable connection means is provided by a pair of notches formed in a respective one of opposed longitudinal side edges of one of said pile connecting plates, and a connector ledge formed adjacent opposed ends of a connecting one of said cross-slots, said notches being dimensioned for close fit reception of an associated one of connector ledges formed adjacent opposed ends of said cross-slots, said connecting one of said cross-slots having opposed aligned angulated passages to permit pivotal side displacement of said one of said pile connecting plates in loose fit connection with the other of said connecting plates captively retained in the other of said cross-slots.

5. The composite pile as claimed in claim 4 wherein said opposed longitudinal side edges have an inward taper at opposed end portions thereof for ease of insertion in said adjacent open ends of said rigid hollow tubes.

6. The composite pile as claimed in claim 1 wherein said impact transfer disc is provided with one or more conduit connecting formations disposed exteriorly of an outer circumferential edge thereof whereby to retain a conduit adjacent said tubes.

7. The composite pile as claimed in claim 6 wherein said one or more conduit connecting formations are integrally formed with said impact transfer disc and constituted by a pair of space-apart rigid curved clamping fingers defining a restrictive throat opening between opposed outer ends thereof leading to a retention cavity configured to receive said conduit in close fit therein.

8. The composite pile as claimed in claim 7 wherein said conduit is a flexible conduit for snap-fit retention into said retention cavity, said conduit being one of a geothermal conduit, an electrical cable or a hollow conduit for the passage of hydraulic lines, electrical wires, cables, and other devices therein.

9. The composite pile as claimed in claim 1 wherein said impact transfer disc has external connection means to secure conduit connecting hook members thereto for pulling a U-shaped end of a conduit loop into the soil.

10. The composite pile as claimed in claim 1 wherein said boring head is a pile supporting bore head formed of inter-engaging parts to form a tapered boring outer end section and a pile seating wall section, said tapered boring outer end section being formed by a pair of inter-engaging plates, each defining said tapered outer end section in a forward portion thereof and a tube connecting section in a rearward portion thereof, and interconnecting support means to supportingly connect said pile seating flange wall section thereto.

11. The composite pile as claimed in claim 10 wherein said pile seating flange wall section is a seating disc, said seating disc having cross-slots at a central location thereof for the passage of said pair of inter-engaging plates, said seating disc extending outwardly about the outer circumference of said leading lower end of said lowermost one of said tubes.

12. The composite pile as claimed in claim 11 wherein said rigid hollow tubes have a cross-sectional shape which is one of circular or square, said seating disc being a circular or square seating disc and external connection means secured to said sealing disc to secure conduit connecting hook members thereto for pulling a U-shaped end of a conduit loop into the soil.

13. The composite pile as claimed in claim 12 wherein said conduit is a flexible conduit and being one of a geothermal conduit, an electrical cable or a hollow conduit for the passage of hydraulic lines, electrical wires, cables, and other devices therein.

14. The composite pile as claimed in claim 10 wherein said pair of inter-engaging plates each have a connecting slot extending along a central longitudinal axis thereof, said connecting slot of one of said inter-engaging plates extending from a free end of said outer end section thereof and the other of said connecting slot extending from the free end of said tube connecting section, said slot having a predetermined length whereby said inter-engaging plates are coupled together by inter-engagement of said connecting slots said free ends are in planar alignment with said inter-engaging plates disposed transverse to one another.

15. The composite pile as claimed in claim 14 wherein said tube connecting section of said inter-engaging plates has opposed longitudinal side edges for friction fit against an inner side wall of said lowermost one of said tubes, said opposed longitudinal side edges having an inward taper at an end portion thereof for ease of insertion in an open end of said lowermost one of said tubes.

16. The composite pile as claimed in claim 10 wherein said tapered outer end section of each said inter-engaging plates are of substantially arrowhead shape.

17. The composite pile as claimed in claim 1 wherein said force transmitting member is a rigid disc removably connected to said top end of said rigid hollow tubes and extending across said top end, and a connecting plate dimensioned to fit into said top end for securing said disc transversely over said top end.

18. The composite pile as claimed in claim 17 wherein said rigid disc has a plate receiving slot disposed centrally therethrough, said plate receiving slot being at least as long as the inner diameter of said tubes, said connecting plate having a plate connecting portion dimensioned for close fit across an inner wall of said rigid hollow tubes and opposed shoulder portions extending transversely of said connecting plate at a top end thereof and projecting from opposed side edges of said plate connecting portion for resting abutment on a top surface of said rigid disc adjacent opposed ends of said plate receiving slot.

19. The composite pile as claimed in claim 18 wherein said rigid disc has an outer circumference at least as great as an outer circumference of said rigid hollow tubes, said rigid disc constituting a support base for a concrete column to be formed thereover.

20. The composite pile as claimed in claim 18 wherein said opposed shoulder portions are welded to a top wall of said rigid disc.

21. The composite pile as claimed in claim 17 wherein said rigid disc is provided with a concrete anchor projecting vertical plate having through bores for anchoring within a concrete support footing.

22. The composite pile as claimed in claim 1 wherein said rigid hollow tubes are steel tubes having an outer diameter not exceeding six inches, said rigid hollow tubes have a cross-sectional shape which is one of circular, square and other suitable cross-sectional shape.

23. The composite pile as claimed in claim 1 wherein said force transmitting member is a pile connecting metal bracket adapted to be secured to a structure to be supported by said composite pile, said pile connecting metal bracket having guide means for guiding said two or more rigid hollow tubes, and attachment means for removably connecting a drive mechanism to said pile connecting bracket to drive said rigid hollow tubes into the ground.

24. The composite pile as claimed in claim 23 wherein said structure is a building foundation wall or slab.

25. The composite pile as claimed in claim 23 wherein said guide means is comprised of a pair of elongated straight vertical guide flanges spaced-apart in parallel relationship for close fit on opposed sides of a driven one of said two or more rigid hollow tubes, said guide flanges being welded to said uppermost one of said two or more rigid hollow tubes after said composite pile has come to rest into said soil, said rigid hollow tubes being metal tubes.

26. The composite pile as claimed in claim 23 wherein said guide means is comprised of a pair of space-apart horizontal guide walls each having an aperture therein dimensioned to receive a driven one of said two or more rigid hollow tubes in close guiding fit therethrough, each said horizontal guide walls being secured to structural walls of said pile connecting metal bracket, at least said horizontal guide walls being welded to said uppermost one of said two or more rigid hollow tubes after said composite pile has come to rest into said soil, said rigid hollow tubes being metal tubes.

27. The composite pile as claimed in claim 26 wherein said pile connecting metal bracket has a foot plate for lifting engagement under said structure, said structure being a building foundation or slab.

28. The composite pile as claimed in claim 23 wherein said attachment means are attachment flanges to which a hydraulic ram or screw lifting system is attached.

29. A pile connector for interconnecting rigid hollow pile tubes end-to-end and for transmitting driving forces between adjacent ends of said rigid hollow pile tubes, said pile connector having opposed axially aligned projecting pile connecting members extending from opposed parallel faces of a transverse impact transfer disc, said impact transfer disc being dimensioned to extend to an outer periphery of circumferential end edges of said rigid hollow pile tubes interconnected end-to-end said pile connector being comprised of said impact transfer disc and a pair of inter-engaging pile connecting plates, said pile connecting plates being dimensioned to extend a predetermined distance in said rigid hollow tube and in frictional engagement with an inner side wall of said rigid hollow tubes from said adjacent open ends, interconnection means to interconnect said pile connecting plates together in transverse relationship along a central longitudinal axis thereof, said impact transfer disc having cross-slots dimensioned for receiving said interconnected pile connecting plates therethrough, and removable connection means to secure said interconnected pile connecting plates to said impact transfer disc at substantially mid-length of said pile connecting plates.

30. The pile connector as claimed in claim 29 wherein said interconnection means is comprised of a plate connecting slot formed in each said pile connecting plate and extending along said central longitudinal axis from an adjacent end edge of said pile connecting plates and terminating at said mid-length of said pile connecting plates.

31. The pile connector as claimed in claim 30 wherein said plate connecting slot is dimensioned for loose fit connection with a side wall of said pile connecting plates to permit predetermined angular displacement between said plates.

32. The pile connector as claimed in claim 29 wherein said removable connection means is provided by a pair of notches formed in a respective one of opposed longitudinal side edges of one of said pile connecting plates, and a connector ledge formed adjacent opposed ends of a connecting one of said cross-slots, said notches being dimensioned for close fit reception of an associated one of said connector ledges therein, said connecting one of said cross-slots having opposed aligned angulated passages to permit pivotal side displacement of said one of said pile connecting plates in loose fit connection with the other of said connecting plates captively retained in the other of said cross-slots.

33. The pile connector as claimed in claim 32 wherein said opposed longitudinal side edges have an inward taper at opposed end portions thereof for ease of insertion in said adjacent open ends of said rigid hollow tubes.

34. A pile supporting boring head for securement to a lower end of a rigid hollow pile tube to be driven into the ground, said pile supporting head being formed of inter-engaging parts to form a tapered boring outer end section and a pile seating wall section, said tapered boring outer end section being formed by a pair of inter-engaging plates each defining said tapered outer end section in a forward portion thereof and a tube connecting section in a rearward portion thereof, interconnecting support means to supportingly connect said pile seating flange wall section thereto, said pile seating flange wall section is a seating disc having cross-slots at a central location thereof for passage of said pair of inter-engaging plates, said seating disc extending outwardly about an outer circumference of a lower end of said rigid hollow pile tube.

35. The pile supporting boring head as claimed in claim 34 wherein said pair of inter-engaging plates each have a connecting slot extending along a central longitudinal axis thereof, said connecting slot of one of said inter-engaging plates extending from a free end of said outer end section thereof and the other of said connecting slot extending from the free end of said tube connecting section, said connecting slot having a predetermined length whereby said inter-engaging plates are coupled together by inter-engagement of said connecting slots said free ends are in planar alignment with said inter-engaging plates disposed transverse to one another.

36. The supporting boring head as claimed in claim 35 wherein said tube connecting section of said inter-engaging plates have opposed longitudinal side edges for friction fit against an inner side wall of said rigid hollow pile tube, said opposed longitudinal side edges having an inward taper at an end portion thereof for ease of insertion in an open end of said lowermost one of said tubes.

37. The pile supporting boring head as claimed in claim 34 wherein said tapered outer end section of each said inter-engaging plate is of substantially arrowhead shape.

38. The pile supporting boring head as claimed in claim 34 wherein said rigid hollow tubes have a cross-sectional shape which is one of circular and square, said seating disc being a circular or square seating disc and external connection means secured to said sealing disc to secure conduit connecting hook members thereto for pulling a U-shaped end of a conduit loop into the soil.

39. A force transmitting member for removable connection to a top end of a rigid hollow pile tube to be driven into the ground and adapted to receiving a driving force, said force transmitting member being a rigid disc removably connected to a top end of said rigid hollow tube and extending across said top end, a connecting plate dimensioned to fit into said top end for securing said disc transversely over said top end, said rigid disc having a plate receiving slot disposed centrally therethrough, said plate receiving slot being at least as long as an inner diameter of said tube, said connecting plate having a plate connecting portion dimensioned for close fit across an inner wall of said rigid hollow tubes and opposed shoulder portions extending transversely of said connecting plate at a top end thereof and projecting from opposed side edges of said plate connecting portion for resting abutment on a top surface of said rigid disc adjacent opposed ends of said plate receiving slot.

40. The force transmitting member as claimed in claim 39 wherein said rigid disc has an outer circumference at least as great as an outer circumference of said rigid hollow tubes, said rigid disc constituting a support base for a concrete column to be formed thereover.

41. The force transmitting member as claimed in claim 39 wherein said rigid disc is provided with a concrete anchor projecting vertical plate having through bores for anchoring within a concrete support footing.

42. A composite pile comprising two or more rigid hollow tubes interconnected together end-to-end by a pile connector, a boring head secured to a leading lower end of a lowermost one of said tubes, and a force transmitting member removably connectable to a top end of an uppermost one of said rigid hollow tubes to receive a driving force for driving each said two or more rigid hollow tubes into the soil, said pile connector having opposed axially aligned projecting pile connecting members extending from opposed parallel faces of a transverse impact transfer disc and extending a predetermined distance in adjacent open ends of said tubes to maintain said tubes in axial alignment with one another, said impact transfer disc being dimensioned to extend to an outer periphery of circumferential end edges of said rigid hollow tubes interconnected end-to-end and to receive said end edges in contact with said opposed parallel faces to transfer said driving force substantially uniformly between said end edges of said tubes interconnected together, said impact transfer disc being provided with one or more conduit connecting formations disposed exteriorly of an outer circumferential edge thereof whereby to retain a conduit adjacent said tubes, said one or more conduit connecting formations being integrally formed with said impact transfer disc and constituted by a pair of space-apart rigid curved clamping fingers defining a restrictive throat opening between opposed outer ends thereof leading to a retention cavity configured to receive said conduit in close fit therein.

43. The composite pile as claimed in claim 42 wherein said conduit is a flexible conduit for snap-fit retention into said retention cavity, said conduit being one of a geothermal conduit, an electrical cable or a hollow conduit for the passage of hydraulic lines, electrical wires, cables, and other devices therein.

44. A composite pile comprising two or more rigid hollow tubes interconnected together end-to-end by a pile connector, a boring head secured to a leading lower end of a lowermost one of said tubes, and a force transmitting member removably connectable to a top end of an uppermost one of said rigid hollow tubes to receive a driving force for driving each said two or more rigid hollow tubes into the soil, said pile connector having opposed axially aligned projecting pile connecting members extending from opposed parallel faces of a transverse impact transfer disc and extending a predetermined distance in adjacent open ends of said tubes to maintain said tubes in axial alignment with one another, said impact transfer disc being dimensioned to extend to an outer periphery of circumferential end edges of said rigid hollow tubes interconnected end-to-end and to receive said end edges in contact with said opposed parallel faces to transfer said driving force substantially uniformly between said end edges of said tubes interconnected together, said boring head being a pile supporting bore head formed of inter-engaging parts to form a tapered boring outer end section and a pile seating wall section, said tapered boring outer end section being formed by a pair of inter-engaging plates, each defining said tapered outer end section in a forward portion thereof and a tube connecting section in a rearward portion thereof, and interconnecting support means to supportingly connect said pile seating flange wall section thereto, said pile seating flange wall section being a seating disc, said seating disc having cross-slots at a central location thereof for the passage of said pair of inter-engaging plates, said seating disc extending outwardly about the outer circumference of said leading lower end of said lowermost one of said tubes.

45. The composite pile as claimed in claim 44 wherein said tapered outer end section of each said inter-engaging plates is of substantially arrowhead shape.

46. The composite pile as claimed in claim 44 wherein said rigid hollow tubes have a cross-sectional shape which is one of circular and square, said seating disc being a circular or square seating disc and external connection means secured to said seating disc to secure conduit connecting hook members thereto for pulling a U-shaped end of a conduit loop into the soil.

47. The composite pile as claimed in claim 44 wherein said tube connecting section of said inter-engaging plates has opposed longitudinal side edges for friction fit against an inner side wall of said lowermost one of said tubes, said opposed longitudinal side edges having an inward taper at an end portion thereof for ease of insertion in an open end of said lowermost one of said tubes.

48. A composite pile comprising two or more rigid hollow tubes interconnected together end-to-end by a pile connector, a boring head secured to a leading lower end of a lowermost one of said tubes, and a force transmitting member removably connectable to a top end of an uppermost one of said rigid hollow tubes to receive a driving force for driving each said two or more rigid hollow tubes into the soil, said pile connector having opposed axially aligned projecting pile connecting members extending from opposed parallel faces of a transverse impact transfer disc and extending a predetermined distance in adjacent open ends of said tubes to maintain said tubes in axial alignment with one another, said impact transfer disc being dimensioned to extend to an outer periphery of circumferential end edges of said rigid hollow tubes interconnected end-to-end and to receive said end edges in contact with said opposed parallel faces to transfer said driving force substantially uniformly between said end edges of said tubes interconnected together, said force transmitting member being a rigid disc removably connected to said top end of said rigid hollow tubes and extending across said top end, and a connecting plate dimensioned to fit into said top end for securing said disc transversely over said top end, said rigid disc having a plate receiving slot disposed centrally therethrough, said plate receiving slot being at least as long as the inner diameter of said tubes, said connecting plate having a plate connecting portion dimensioned for close fit across an inner wall of said rigid hollow tubes and opposed shoulder portions extending transversely of said connecting plate at a top end thereof and projecting from opposed side edges of said plate connecting portion for resting abutment on a top surface of said rigid disc adjacent opposed ends of said plate receiving slot.

49. The composite pile as claimed in claim 48 wherein said rigid disc has an outer circumference at least as great as the outer circumference of said rigid hollow tubes, said rigid disc constituting a support base for a concrete column to be formed thereover.

50. The composite pile as claimed in claim 48 wherein said rigid disc is provided with a concrete anchor projecting vertical plate having through bores for anchoring within a concrete support footing.

51. The composite pile as claimed in claim 48 wherein said opposed shoulder portions are welded to a top wall of said rigid disc.

52. A composite pile comprising two or more rigid hollow tubes interconnected together end-to-end by a pile connector, a boring head secured to a leading lower end of a lowermost one of said tubes, and a force transmitting member removably connectable to a top end of an uppermost one of said rigid hollow tubes to receive a driving force for driving each said two or more rigid hollow tubes into the soil, said pile connector having opposed axially aligned projecting pile connecting members extending from opposed parallel faces of a transverse impact transfer disc and extending a predetermined distance in adjacent open ends of said tubes to maintain said tubes in axial alignment with one another, said impact transfer disc being dimensioned to extend to an outer periphery of circumferential end edges of said rigid hollow tubes interconnected end-to-end and to receive said end edges in contact with said opposed parallel faces to transfer said driving force substantially uniformly between said end edges of said tubes interconnected together, said force transmitting member being a pile connecting metal bracket adapted to be secured to a structure to be supported by said composite pile, said pile connecting metal bracket having guide means for guiding said two or more rigid hollow tubes, and attachment means for removably connecting a drive mechanism to said pile connecting bracket to drive said rigid hollow tubes into the ground, said guide means being comprised of a pair of spaced-apart horizontal guide walls each having an aperture therein dimensioned to receive a driven one of said two or more rigid hollow tubes in close guiding fit therethrough, each said horizontal guide walls being secured to structural walls of said pile connecting metal bracket, at least said horizontal guide walls being welded to said uppermost one of said two or more rigid hollow tubes after said composite pile has come to rest into said soil, said rigid hollow tubes being metal tubes.

53. The composite pile as claimed in claim 52 wherein said structure is a building foundation wall or slab.

54. The composite pile as claimed in claim 52 wherein said guide means is comprised of a pair of elongated straight vertical guide flanges spaced-apart in parallel relationship for close fit on opposed sides of a driven one of said two or more rigid hollow tubes, said guide flanges being welded to said uppermost one of said two or more rigid hollow tubes after said composite pile has come to rest into said soil, said rigid hollow tubes being metal tubes.

55. The composite pile as claimed in claim 52 wherein said pile connecting metal bracket has a foot plate for lifting engagement under said structure, said structure being a building foundation or slab.

56. The composite pile as claimed in claim 52 wherein said attachment means are attachment flanges to which a hydraulic ram or screw lifting system is attached.

* * * * *